US007029287B2

(12) United States Patent
Matsunaga et al.

(10) Patent No.: US 7,029,287 B2
(45) Date of Patent: Apr. 18, 2006

(54) ELECTRICAL CONNECTOR IN WHICH A WIPING ACTION IS CARRIED OUT IN A NARROW AREA

(75) Inventors: Akihiro Matsunaga, Tokyo (JP); Masaaki Shimada, Tokyo (JP); Akira Natori, Tokyo (JP); Keiichiro Suzuki, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 11/147,558

(22) Filed: Jun. 8, 2005

(65) Prior Publication Data

US 2005/0277338 A1 Dec. 15, 2005

(30) Foreign Application Priority Data

Jun. 9, 2004 (JP) ..... 2004-171062

(51) Int. Cl.
*H01R 12/00* (2006.01)

(52) U.S. Cl. ..... 439/65; 439/862; 439/289

(58) Field of Classification Search ..... 439/660, 439/289, 862, 700, 824, 500, 65, 66, 81; D13/120, 133, 147

See application file for complete search history.

(56) References Cited

U.S. PATENT DOCUMENTS 5,437,556 A * 8/1995 Bargain et al. ..... 439/66
6,022,248 A * 2/2000 Wu et al. ..... 439/862
6,077,130 A * 6/2000 Hughes et al. ..... 439/862
6,875,049 B1 * 4/2005 Kyowski et al. ..... 439/500

FOREIGN PATENT DOCUMENTS

JP 11-74014 A 3/1999

* cited by examiner

*Primary Examiner*—Tho D. Ta
(74) *Attorney, Agent, or Firm*—Frishauf, Holtz, Goodman & Chick, P.C.

(57) ABSTRACT

In an electrical connector to be connected to a mating connector in a predetermined direction, an insulator defines an accommodating space and an opening communicating the accommodating space in the predetermined direction. A contact as a base portion held by the insulator and a spring portion connected to the base portion. The spring portion has a first portion extending from the base portion in the accommodating space to intersect with the predetermined direction, a second portion turned opposite to the opening from the first portion and extending in the accommodating space to intersect with the predetermined direction, and a third portion extending from the second portion to pass through the opening. The third portion has a contact portion located outside the accommodating space to be elastically contacted with the mating connector.

8 Claims, 2 Drawing Sheets

ELECTRICAL CONNECTOR IN WHICH A WIPING ACTION IS CARRIED OUT IN A NARROW AREA

This application claims priority to prior Japanese patent application JP 2004-171062, the disclosure of which is incorporated herein by reference.

BACKGROUND OF THE INVENTION

The present invention relates to an electrical connector to be connected to a mating electrical connector and, in particular, to an electrical connector having a wiping function known in the art.

For example, an electrical connector of the type is disclosed in Japanese Unexamined Patent Application Publication (JP-A) No. H11-074014 (Reference 1). The electrical connector comprises a contact and a housing holding the contact. The contact includes a fixing part fixed to the housing, a spring part extending in an inner space of the housing, and a contact part connected to the spring part and exposed out of the housing. The spring part is bent at a sharp angle from the fixing part to extend in a first direction and is turned to extend in a second direction opposite to the first direction. Namely, the spring part snakes in the inner space of the housing.

When a mating contact is pushed on the contact part, the spring part is bent with movement of the contact part. At this moment, the contact part slides on the mating contact to cause a wiping action therebetween.

However, in the above-mentioned electrical connector, a range of the wiping action is enlarged more than the necessity. This is because the spring part snakes in the inner space of the housing. Accordingly, it is difficult to miniaturize the mating contact.

SUMMARY OF THE INVENTION

It is therefore an object of the present invention to provide an electrical connector in which a spring portion has enough deformability and which is capable of adequately controlling an area of a wiping action.

It is another object of the present invention to provide an electrical connector of the type described, which can be reduced in size.

Other objects of the present invention will become clear as the description proceeds.

According to an aspect of the present invention, there is provided an electrical connector to be connected to a mating connector in a predetermined direction, the electrical connector comprising a contact having conductivity and an insulator holding the contact, the insulator defining an accommodating space and an opening communicating with the accommodating space in the predetermined direction, the contact having a base portion held by the insulator and a spring portion connected to the base portion, the spring portion having a first portion extending from the base portion in the accommodating space to intersect with the predetermined direction, a second portion turned opposite to the opening from the first portion and extending in the accommodating space to intersect with the predetermined direction, and a third portion extending from the second portion to pass through the opening, the third portion having a contact portion located outside the accommodating space to be elastically contacted with the mating connector.

DESCRIPTION OF THE PREFERRED EMBODIMENT

Figure 1:
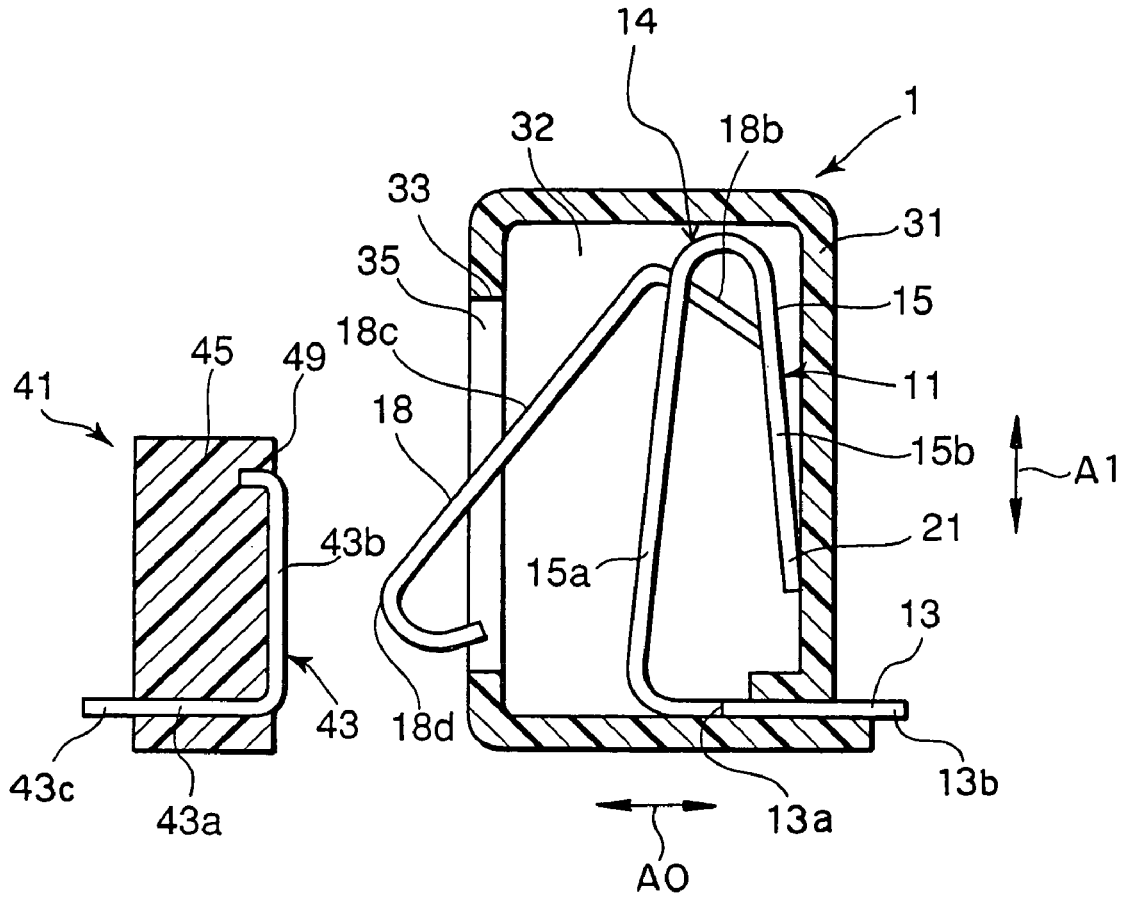
FIG. 1 is a cross-sectional view of an electrical connector according to an embodiment of the present invention, together with a mating connector to be connected thereto.
Figure 2:
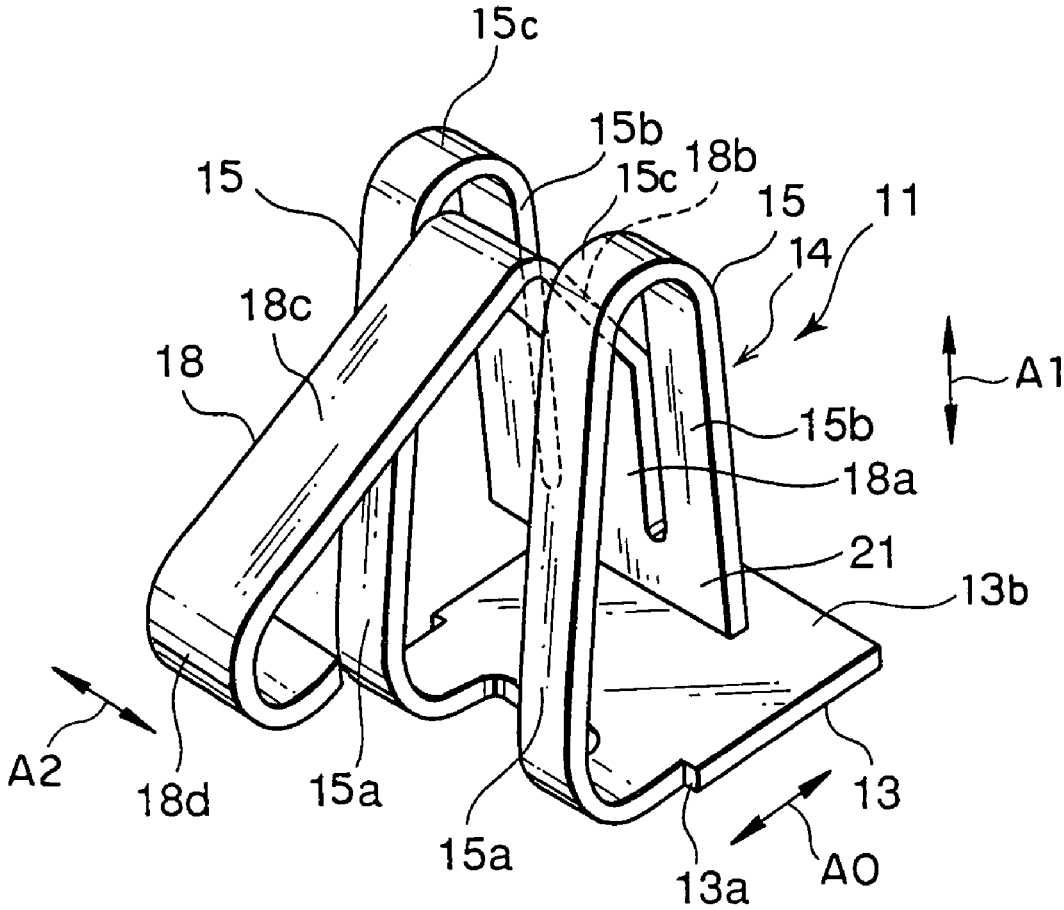
FIG. 2 is a perspective view of a contact included in the electrical connector of FIG. 1.

Referring to FIGS. 1 and 2, description will be made as regards an electrical connector according to an embodiment of this invention.

The electrical connector in the figures is depicted by a reference numeral 1 and is adapted to be connected with a mating connector 41 in a predetermined direction A0. The mating connector 41 comprises a mating insulator 45 of a plastic material and a mating contact 43 coupled to the mating insulator 45. The mating contact 43 has conductivity and has a mating base portion 43*a* molded in and fixed to the mating insulator 45, a mating contact portion 43*b* extending along a principal surface 49, and a mating terminal portion 43*c* to be connected with a mating circuit board or a cable of a battery charger by soldering.

The electrical connector 1 comprises a conductive contact 11 and an insulator 31 holding the contact 11 by a molding technique. The insulator 31 is made of a plastic material and defines an accommodating space 32. The insulator 31 has a wall part 33 defining an opening 35 communicating with the accommodating space 32 in the predetermined direction A0.

The contact 11 is formed by pressing and punching a conductive plate member and has a base portion 13 held or molded by the insulator 31 and a spring portion 14 connected to the base portion 13. The base portion 13 has an edge portion 13*a* and a terminal portion 13*b* to be connected with a printed circuit board (not shown) or a battery of an electronic device by soldering.

The spring portion 14 has a pair of first spring portions 15 each extending from the edge portion 13*a* of the base portion 13 in a first direction A1 perpendicular to the predetermined direction A0. The fist first spring portions 15 are spaced from each other in a second direction A2 perpendicular to the predetermined and the first directions A0 and A1.

Each of the first spring portions 15 comprises a first spring plate 15*a* and a second spring plate 15*b* connected to the first spring plate 15*a*. The first spring plate 15*a* extends from the edge portion 13*a* of the base portion 13 to intersect with the predetermined direction A0. The second spring plate 15*b* is turned opposite to the opening 35 from the first spring plate 15*a* to form a U-shaped portion 15*c*, and extends in the accommodating space 32 to intersect with the predetermined direction A0. The second spring plate 15*b* has an extended end or a connecting portion 21 which is a free end and is continuously kept in contact with the insulator 31. A combination of the first spring plates 15*a* of the first spring portions 15 may be referred to as a first portion of the spring portion 14. A combination of the second spring plates 15*b* of the first spring portions 15 may be referred to as a second portion of the spring portion 14.

The spring portion 14 further comprises a second spring portion 18 arranged between the first spring portions 15 and connected to the connecting portion 21. The second spring portion 18 comprises a connecting part 18*a* connected to the connecting portion 21 and extends in parallel to the second spring plate 15*b* in the first direction A1.

The second spring portion 18 further comprises an intermediate part 18*b* and an extending part 18*c*. The intermediate part 18*b* extends from the connecting part 18*a* towards the wall part 33 in a particular direction intersecting with the predetermined and the first directions and A0 and A1. The extending part 18*c* makes an angle relative to the intermediate part 18*b* and extends from the intermediate part 18*b* to face a space left between the first spring plates 15*a*. The connecting part 18*a*, the intermediate part 18*b*, and the extending part 18*c* are cooperated with one another to form a shape approximate to a general U-shape.

The extending part 18*c* passes through the opening 32 and projects outward from the insulator 31. The extending part 18*c* is provided with a contact portion 18*d* which is exposed out of the opening 35 to be contacted with the mating contact portion 43*b* of the mating connector 41. The contact portion 18*d* is bent or rounded to form a substantially U-shaped portion. The second spring portion 18 may be referred to as a third portion.

Next, the description will be directed to an operation of connecting the connector 1 and the mating connector 41. Herein, the connector 1 and the mating connector 41 may be called a plug connector and a receptacle connector, respectively. In this event, the connector 1 is moved to bring the contact portion 18*d* into contact with the mating contact portion 43*b* of the mating contact 43. When the connector 1 is further pushed towards the mating connector 41, the contact portion 18*d* is brought into press contact with the mating contact portion 43*b*.

When the contact portion 18*d* is pushed towards the mating contact portion 43*b*, the first and the second spring portions 15 and 18 are deformed in the first direction A1. In this event, the second spring portion 18 has a deformation greater than that of the first spring portion 15. In response to the deformations of the first and the second spring portions 15 and 18, the contact portion 18*d* slides on the mating contact portion 43*b*. Consequently, a wiping action is carried out between the contact portion 18*d* and the mating contact portion 43*b* in the manner known in the art. Therefore, dusts and so on are removed from the contact portion 18*d* and the mating contact portion 43*b* by the wiping action. It is to be noted that the wiping action is carried out in a narrow area. This is because the deformations are cancelled by each other in the first direction A1.

While the present invention has thus far been described in connection with a single embodiment thereof, it will readily be possible for those skilled in the art to put this invention into practice in various other manners. For example, although the above-mentioned contact has the pair of first spring portions, the contact may be provided with only one of the first spring portions. The connector may be designed so that the connecting portion of the second spring portion comes into contact with the insulator only when the contact portion of the second spring portion is pushed towards the accommodating space of the insulator, or that the connecting portion does not contact with the insulator even when the contact portion is pushed. A plurality of contacts may be arranged in the second direction with a space left between every adjacent ones.

What is claimed is:

1. An electrical connector to be connected to a mating connector in a predetermined direction, wherein said electrical connector comprises a conductive contact and an insulator holding said contact, wherein said insulator defines an accommodating space and an opening communicating with said accommodating space in said predetermined direction, and wherein said contact includes a base portion held by said insulator and a spring portion connected to said base portion, said spring portion comprising:

a first portion extending from said base portion in said accommodating space along a direction intersecting with said predetermined direction;

a second portion which extends from said first portion away from said opening and extends in said accommodating space along a direction intersecting with said predetermined direction, and which comprises an extended end that is a free end; and a third portion which extends from said second portion to pass through said opening, and which comprises a contact portion located outside said accommodating space to be elastically contacted with said mating connector.

2. The connector according to claim 1, wherein said second portion comprises a U-shaped portion connected to said first portion.

3. The connector according to claim 1, wherein said extended end is in contact with said insulator.

4. The connector according to claim 1, wherein a combination of said first and said second portions serves as a first spring portion, said insulator comprises a wall part defining said opening, and said third portion comprises:

a connecting part connected to said second portion and extending in parallel to said second portion in a first direction substantially perpendicular to said predetermined direction;

an intermediate part extending from said connecting part towards said wall part in a direction intersecting with both said predetermined direction and a third direction which is perpendicular to said predetermined direction and said first direction; and an extending part extending from said intermediate part to pass through said opening, said contact portion being formed on said extending part;

wherein a combination of said connecting part, said intermediate part, and said extending part serves as a second spring portion.

5. The connector according to claim 4, wherein said intermediate and said extending parts make an angle with respect to each other.

6. An electrical connector to be connected to a mating connector in a predetermined direction, wherein said electrical connector comprises a conductive contact and an insulator holding said contact, wherein said insulator defines an accommodating space and an opening communicating with said accommodating space in said predetermined direction, and wherein said contact includes a base portion held by said insulator and a spring portion connected to said base portion, said spring portion comprising:

a first portion extending from said base portion in said accommodating space along a direction intersecting with said predetermined direction;

a second portion which extends from said first portion away from said opening and extends in said accommodating space along a direction intersecting with said predetermined direction, and which comprises an extended end that is a free end; and a third portion which extends from said second portion to pass through said opening, and which comprises a contact portion located outside said accommodating space to be elastically contacted with said mating connector;

wherein said first portion comprises a pair of spring plates spaced from each other and extending to intersect with said predetermined direction, and said third portion passes between said spring plates.

7. The connector according to claim 6, wherein said second portion comprises a pair of spring plates spaced from each other and respectively connected to said spring plates of said first portion, and said third portion comprises a connecting part which is placed between said spring plates of said second portion and connected to said spring plates of said second portion.

8. The connector according to claim 6, wherein said third portion comprises an extending part facing a space between said spring plates of said first portion, and said contact portion is formed on said extending part.

* * * * *